US008038021B2

(12) United States Patent
Chen

(10) Patent No.: US 8,038,021 B2
(45) Date of Patent: Oct. 18, 2011

(54) SECTIONAL RACK

(75) Inventor: Henry Chen, Taipei (TW)

(73) Assignee: Protrend Co., Ltd, Taipei (TW)

( * ) Notice: Subject to any disclaimer, the term of this patent is extended or adjusted under 35 U.S.C. 154(b) by 403 days.

(21) Appl. No.: 12/418,331

(22) Filed: Apr. 3, 2009

(65) Prior Publication Data

US 2010/0252521 A1 Oct. 7, 2010

(51) Int. Cl.
*A47B 43/00* (2006.01)

(52) U.S. Cl. ..... 211/192; 211/187

(58) Field of Classification Search ..... 211/191, 211/192, 193, 194, 187, 188, 126.5, 133.3, 211/182, 206; 248/188.1, 188.4, 220.42, 248/244, 243; 108/147.17, 153.1, 107, 108
See application file for complete search history.

(56) References Cited

U.S. PATENT DOCUMENTS

| | | | | | |
|---|---|---|---|---|---|
| 2,261,956 | A * | 11/1941 | Brownlie et al. | ..... | 248/243 |
| 2,622,541 | A * | 12/1952 | Smart | ..... | 104/126 |
| 2,875,904 | A * | 3/1959 | Gingher et al. | ..... | 108/186 |
| 2,925,181 | A * | 2/1960 | Saul, Jr. et al. | ..... | 211/191 |
| 3,655,159 | A * | 4/1972 | Held, Jr. | ..... | 248/188.1 |
| 3,921,539 | A * | 11/1975 | Berger | ..... | 108/8 |
| 4,040,588 | A * | 8/1977 | Papsco et al. | ..... | 248/245 |
| 4,151,917 | A * | 5/1979 | Pugh | ..... | 211/88.01 |
| 4,317,523 | A * | 3/1982 | Konstant et al. | ..... | 211/187 |
| 4,390,103 | A * | 6/1983 | Husband | ..... | 211/182 |
| 4,453,641 | A * | 6/1984 | Rasmussen et al. | ..... | 211/151 |
| 4,515,494 | A * | 5/1985 | Robilliard et al. | ..... | 403/187 |
| 5,174,532 | A * | 12/1992 | Huang | ..... | 248/188.1 |
| 5,205,421 | A * | 4/1993 | Bustos | ..... | 211/59.2 |
| 5,415,302 | A * | 5/1995 | Carlson et al. | ..... | 211/187 |
| 5,433,327 | A * | 7/1995 | Benvenuti et al. | ..... | 211/193 |
| 5,975,318 | A * | 11/1999 | Jay | ..... | 211/90.01 |
| 6,223,916 | B1 * | 5/2001 | Enos | ..... | 211/187 |
| 2004/0035810 | A1 * | 2/2004 | Eustace | ..... | 211/162 |
| 2005/0056604 | A1 * | 3/2005 | Chen | ..... | 211/182 |
| 2006/0096939 | A1 * | 5/2006 | Liu | ..... | 211/189 |
| 2007/0110511 | A1 * | 5/2007 | Chen | ..... | 403/230 |
| 2007/0221595 | A1 * | 9/2007 | Chen | ..... | 211/103 |
| 2009/0014400 | A1 * | 1/2009 | Nawrocki | ..... | 211/90.03 |

* cited by examiner

*Primary Examiner* — Darnell Jayne
*Assistant Examiner* — Patrick Hawn
(74) *Attorney, Agent, or Firm* — WPAT, PC; Justin King

(57) ABSTRACT

A sectional rack, which can be assembled without using fastening elements and tools, includes rectangular vertical posts, foot members connected to lower front and lower rear ends of the vertical posts, hook members hooked to hanging holes provided on lateral faces of the vertical posts, and crossbars mounted to lower and higher positions between two adjacent vertical posts via the hook members. When the hook member is hooked to the hanging holes, an insertion slot is formed between the hook member and the lateral face of the vertical post. The crossbars are respectively formed on a lower portion at each of two lateral ends with an insertion section for firmly downward inserting into two insertion slots formed on two facing lateral faces of two adjacent vertical posts, so that the two vertical posts are supported by the crossbars to stably stand upright.

12 Claims, 13 Drawing Sheets

SECTIONAL RACK

FIELD OF THE INVENTION

The present invention relates to a sectional rack, and more particularly to a sectional rack having vertical posts with rectangular cross-section and crossbars, which can be assembled without using fastening elements and tools.

BACKGROUND OF THE INVENTION

FIG. 1 shows a very common rack that includes at least one U-shaped metal channel being horizontally fixedly mounted to a wall surface, and a plurality of vertical posts 10 being fastened to and spaced along the horizontal channel and each having two vertical rows of insertion holes 11 provided on a front face thereof. Supporting brackets 12 can be hooked to the insertion holes 11, and metal-wire shelf 13 and rigid shelf 14 can be assembled to the supporting brackets 12 to complete a rack for holding articles thereon. The above-described rack must be fixedly mounted to a wall surface for use, and it is time and labor consuming to assemble and dissemble such rack.

The wall-mount rack with the above-described structure, that is, having vertical posts 10 fixedly attached to a wall and provided with insertion holes 11 for holding supporting brackets 12 thereto, and having shelves 13, 14 supported on the supporting brackets 12 for holding things thereon, has been used among consumers for many years. However, as shown in FIG. 2, there is another type of sectional rack including vertical posts 15 being assembled to a base (not shown), and crossbars 16 being fastened to and between two adjacent vertical posts 15 using screws 18, so that the vertical posts 15 can be held to an upright position. When the crossbars 16 are fastened to the vertical posts 15, some of the insertion holes 17 provided on the vertical posts 15 are partially covered by the crossbars 16 and could not be utilized. Further, screws 18 and other hand tools, such as a screwdriver, are needed to assemble or disassemble the rack. Therefore, both of the above two types of conventional racks require improvement.

It is therefore tried by the inventor to overcome the problems in the conventional sectional racks by developing a sectional rack that can be assembled and disassembled without using fastening elements and tools.

SUMMARY OF THE INVENTION

A primary object of the present invention is to provide a sectional rack consisting of vertical posts and crossbars that can be assembled and disassembled without using fastening elements and tools.

Another object of the present invention is to provide a multi-functional sectional rack, to which metal-wire shelves, rigid shelves, and cabinets can be mounted for holding and organizing different things and articles.

To achieve the above and other objects, the sectional rack according to the present invention includes at least two rectangular-sectioned vertical posts, two crossbars, two foot members, and four hook members. The vertical posts are connected at their lower ends to the foot members. The hook members can be hooked to two facing lateral faces on the two vertical posts. The crossbars can be connected to and between the two vertical posts via the hook members to separately locate at an upper and a lower portion of the sectional rack, so that the vertical posts can be stably maintained in an upright position.

The vertical posts are hollow pipes with a substantially rectangular cross-sectional shape, and are provided on each of two lateral faces with two vertical rows of hanging holes and on each of a front and a rear face with at least one vertical row of hanging holes. Each of the foot members is a long plate being provided near a rear end with a vertically downward extended groove for the front or the rear face at the lower end of the vertical post to insert thereinto. When the hook member is hooked to the hanging holes on the lateral face of the vertical post, an insertion slot is formed between the hook member and the lateral face of the vertical post. The crossbars are formed at respective two lateral ends with an insertion section each for firmly inserting into two insertion slots formed on two facing lateral faces of two adjacent vertical posts, so that the two vertical posts can be held in a stably and upright standing position.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
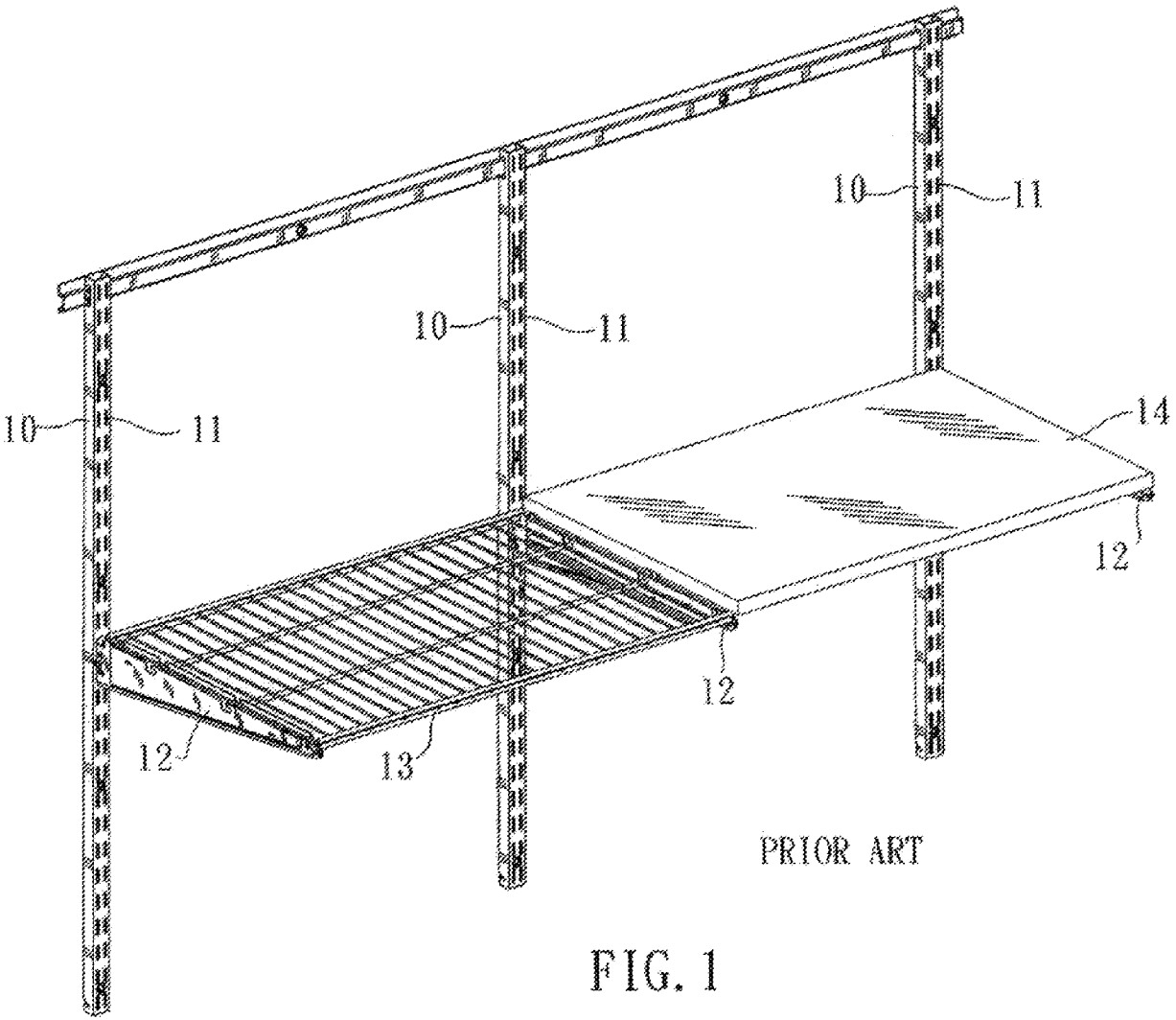
PRIOR ART FIG. 1
FIG. 1 is an assembled perspective view of a first conventional wall-mount rack.
Figure 2:
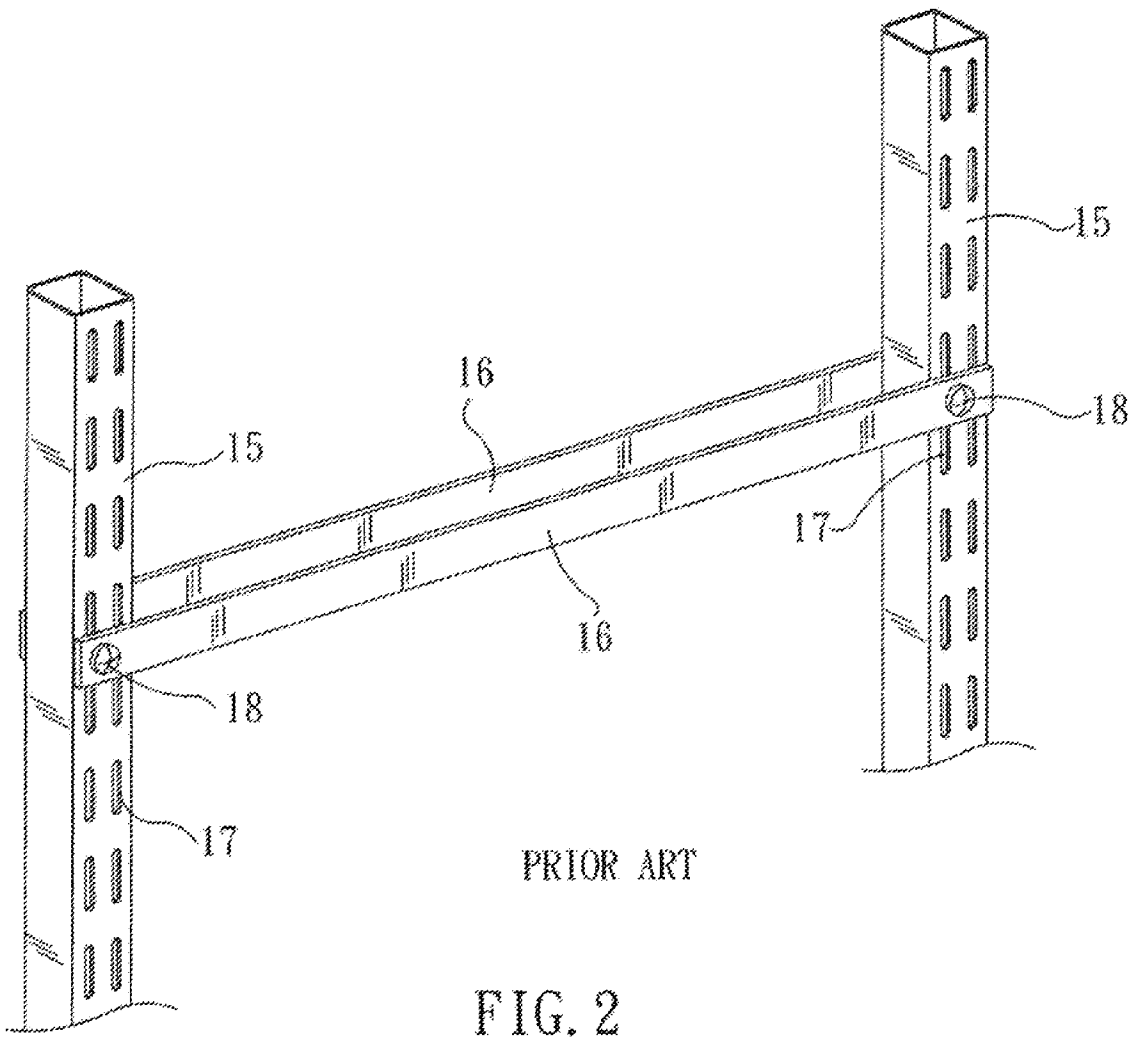
PRIOR ART FIG. 2
FIG. 2 is an assembled perspective view of a second conventional sectional rack.
Figure 3:
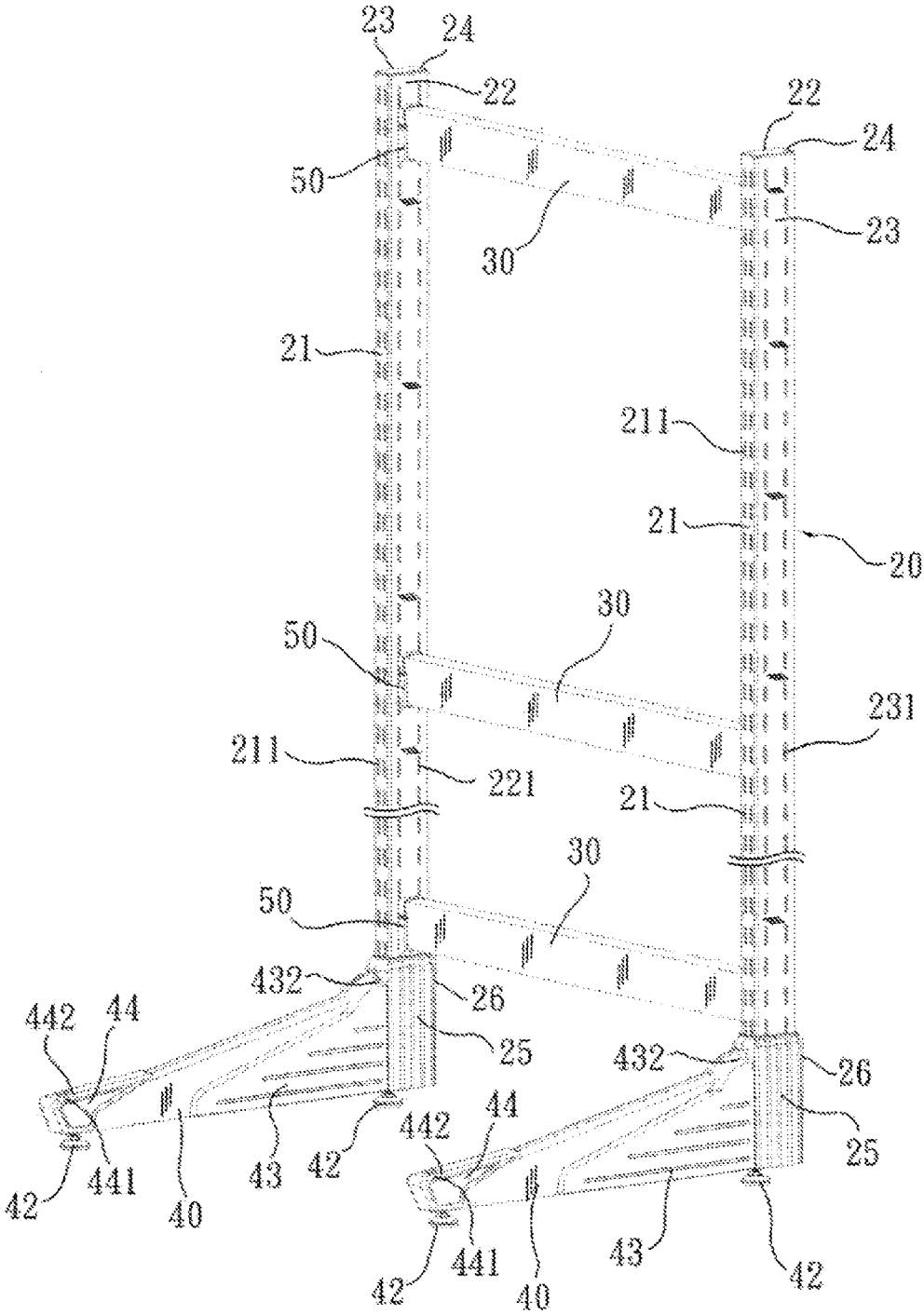
FIG. 3 is an assembled perspective view of a sectional rack according to a preferred embodiment of the present invention.

Please refer to FIG. 3 that is an assembled perspective view of a sectional rack according to a preferred embodiment of the present invention. As shown, the sectional rack includes at least two rectangular-sectioned vertical posts 20, three crossbars 30, two foot members 40, and six hook members 50. The vertical posts 20 are connected at their lower ends to the foot members 40. The hook members 50 can be hooked to two opposite inner lateral faces 22 on two adjacent vertical posts 20. The crossbars 30 can be connected to and between the two vertical posts 20 via the hook members 50 to separately locate, for example, at an upper portion, a middle portion, and a lower portion of the sectional rack, so that the vertical posts 20 can be maintained in an upright position.

Each of the vertical posts 20 is a hollow pipe having a substantially rectangular cross-sectional shape, so as to have a front face 21, an inner lateral face 22, an outer lateral face 23, and a rear face 24. The vertical post 20 is provided on each of the front and the rear face 21, 24 with two vertical rows of hanging holes 211, 241 (also refer to FIG. 13); and on each of the inner and the outer lateral face 22, 23 with two vertical rows of hanging holes 221, 231.

Figure 4:
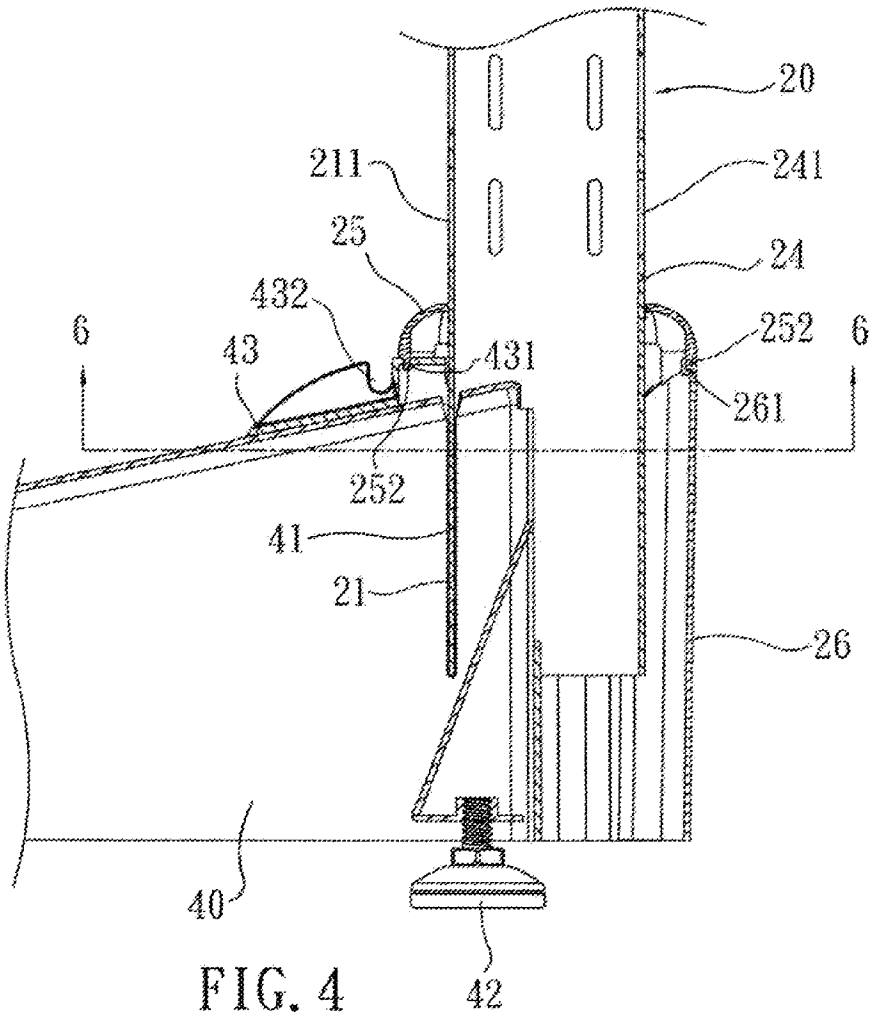
FIG. 4 is a fragmentary sectioned side view showing the connection of a vertical post of the sectional rack of the present invention to a foot member.
Figure 5:
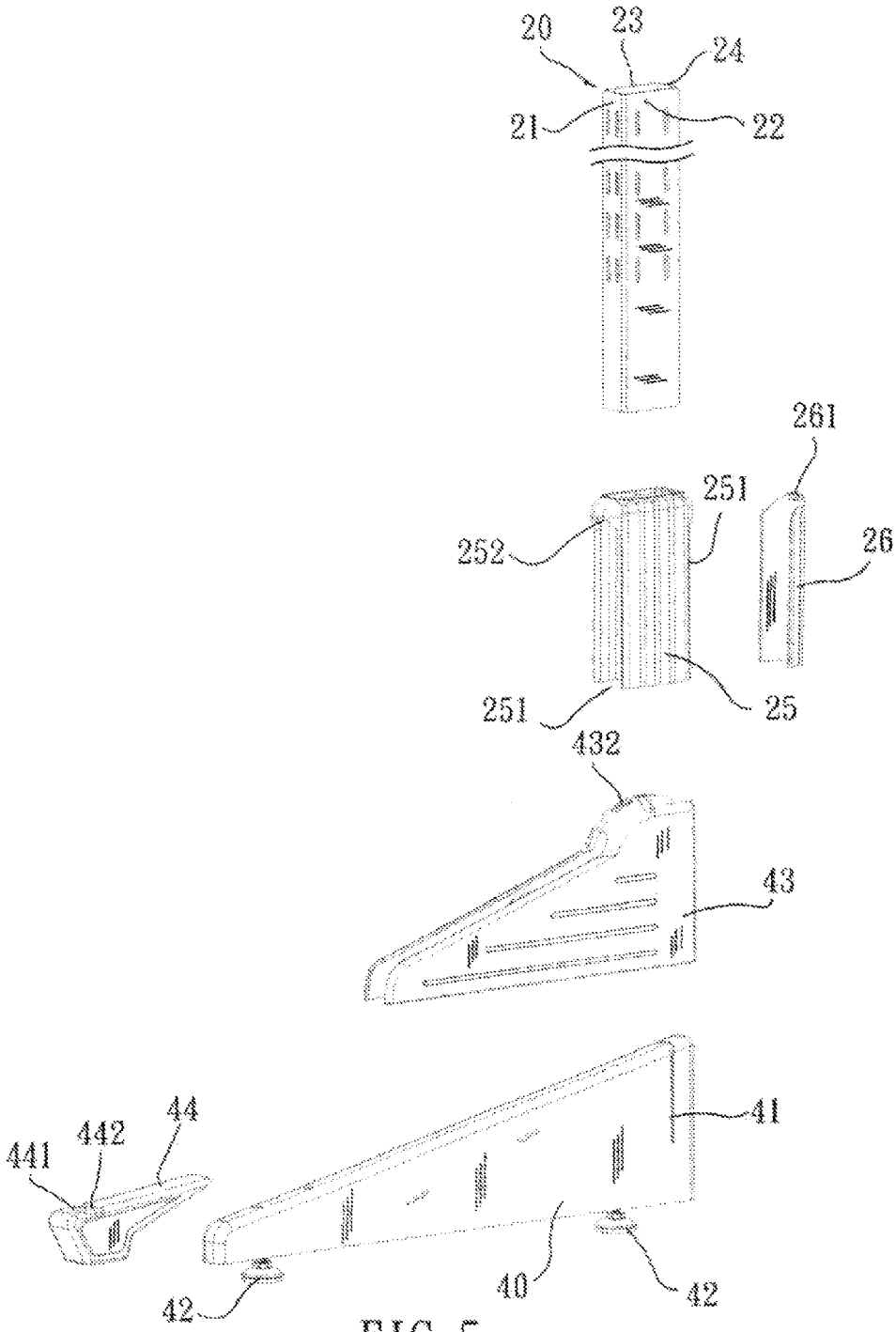
FIG. 5 is an exploded perspective view showing the vertical post and the foot member of the present invention.
Figure 6:
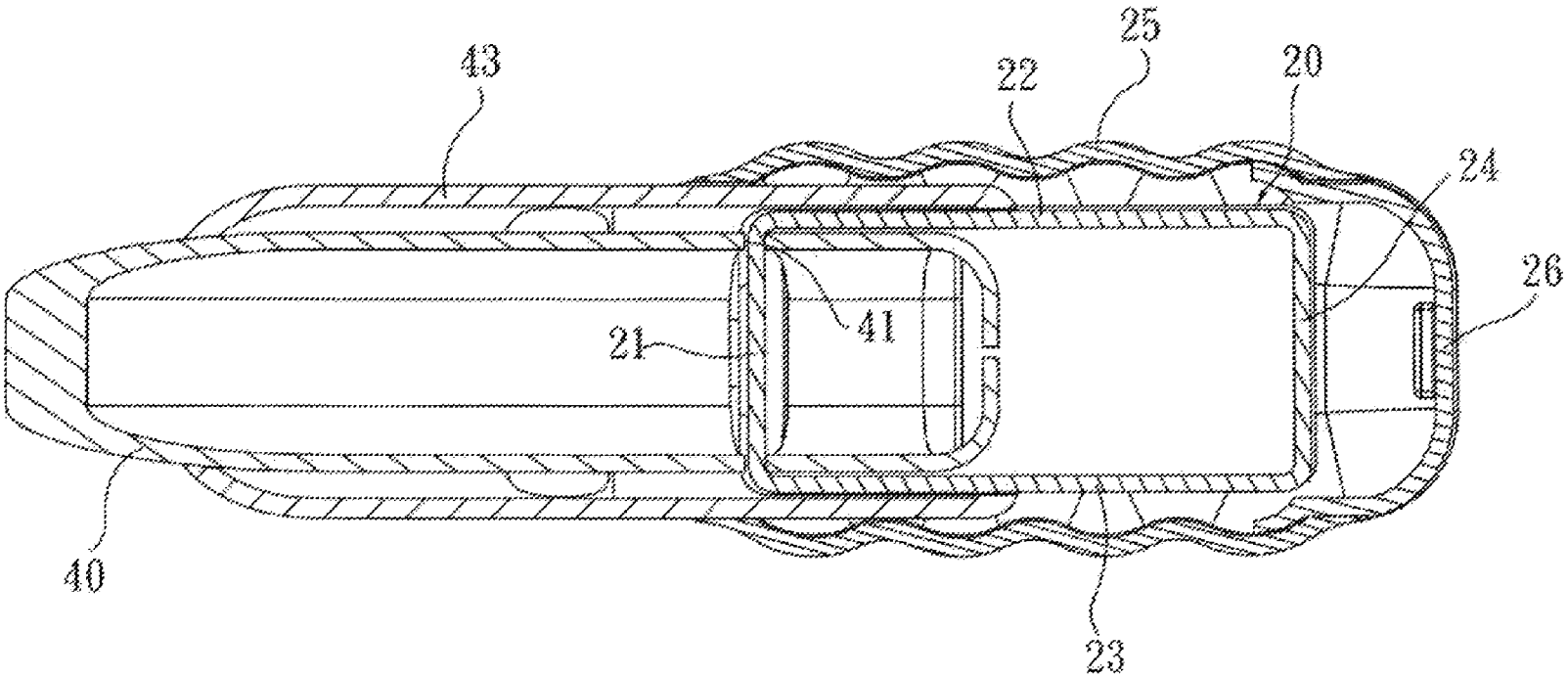
FIG. 6 is a cross-sectional view taken along line 6-6 of FIG. 4.

Please refer to FIGS. 4, 5, and 6. The foot member 40 is in the form of a long plate. A groove 41 is provided near a rear end of the foot member 40 to vertically downward extend from a top of the foot member 40 by a predetermined length to thereby cut through a top and two opposite side wall surfaces of the foot member 40. The front face 21 at the lower end of the vertical post 20 can be inserted into the groove 41, so that a portion of the foot member 40 behind the groove 41 is extended into the lower end of the hollow vertical post 20. It is noted the portion of the foot member 40 extended into the lower end of the vertical post 20 has an overall width close to a distance between two inner surfaces of the inner and the outer lateral face 22, 23 of the vertical post 20. Therefore, when the lower end of the vertical post 20 has been inserted into the groove 41, the front face 21 of the vertical post 20 is tightly clamped in the groove 41 of the foot member 40, and portions of the two opposite side wall surfaces of the foot member 40 behind the groove 41 are separately bearing on the inner surfaces of the inner and the outer lateral face 22, 23 of the vertical post 20, preventing the vertical post 20 from swaying on the foot member 40. Two height-adjusting elements 42 are separately screwed to a bottom of the foot member 40 near a front and a rear end thereof. By screwing the height-adjusting elements 42 into the bottom of the foot member 40 to different depths, the foot member 40 can be adjusted to a stable position.

Figure 7:
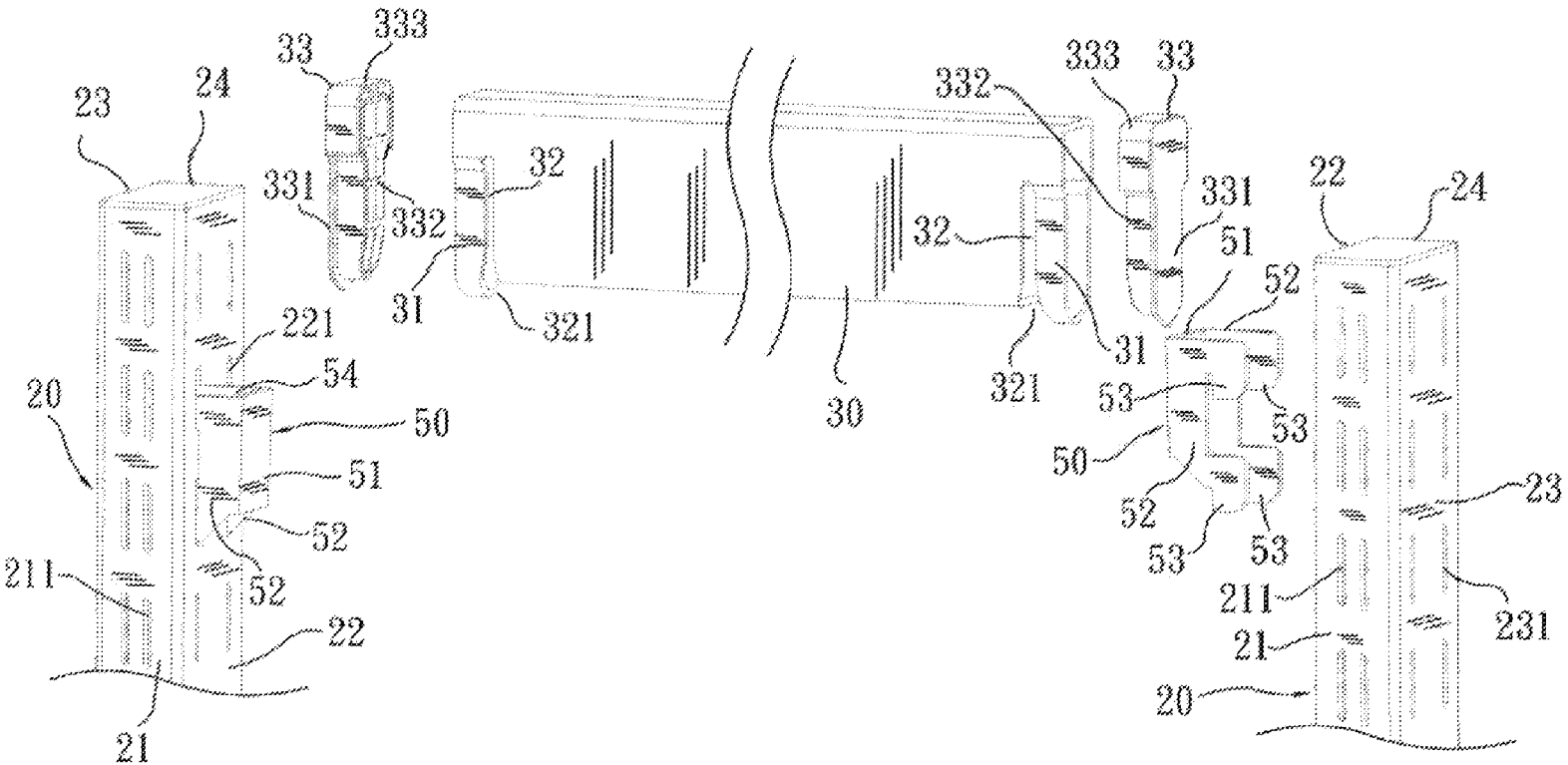
FIG. 7 is a fragmentary exploded perspective view of the sectional rack of the present invention showing the manner of connecting a crossbar to and between two vertical posts via hook members.
Figure 8:
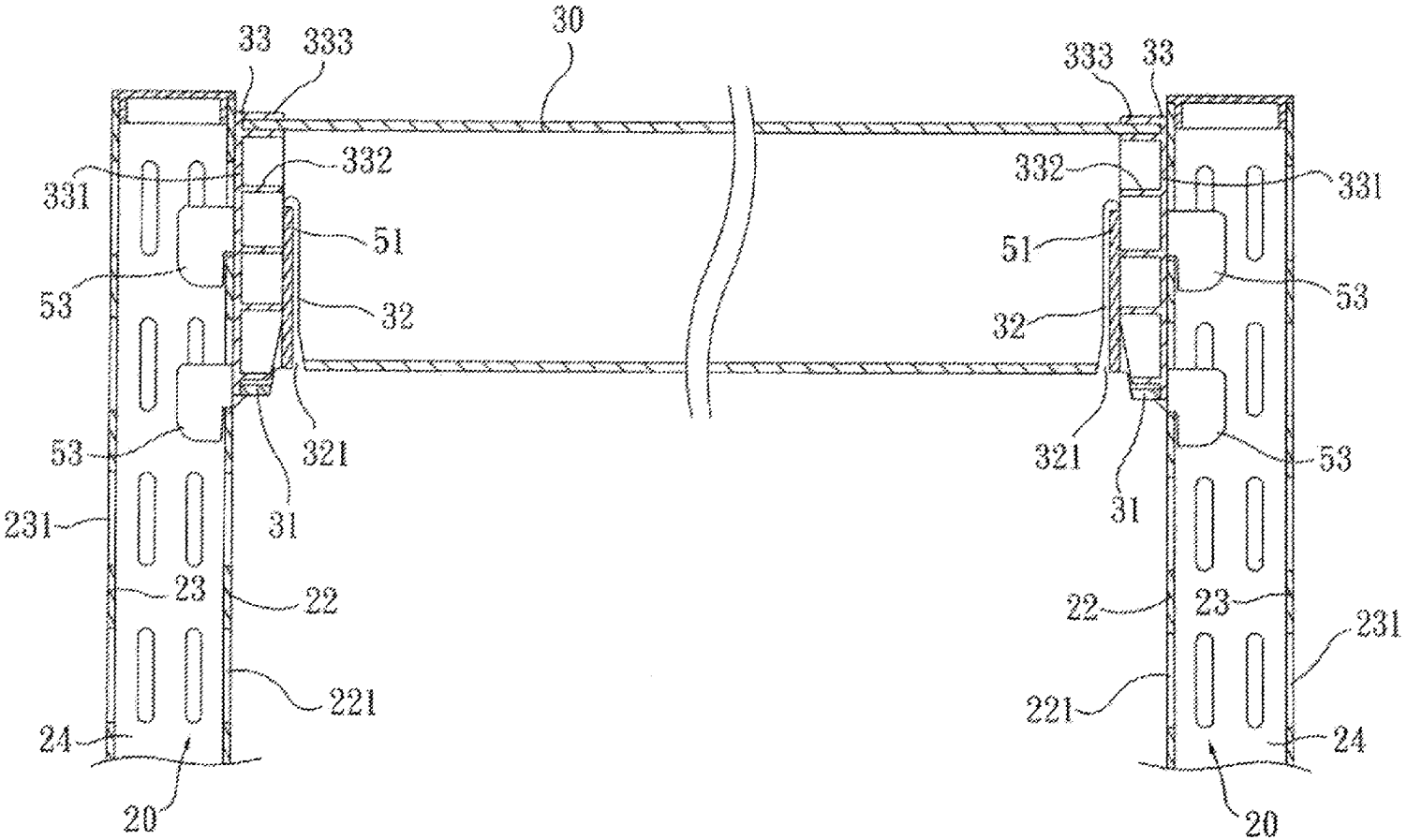
FIG. 8 is an assembled sectional view of FIG. 7.

Please refer to FIGS. 7 and 8. The hook member 50 is a substantially lying U-shaped plate having a middle plate portion 51 and two arm portions 52 perpendicular to and parallelly extended from two opposite lateral edges of the middle plate portion 51. The arm portions 52 are formed at respective distal end with at least one hook portion 53 for hooking to the two rows of hanging holes 221 provided on the inner lateral face 22 of the vertical post 20. When the hook member 50 has been hooked to hanging holes 221 on the inner lateral face 22 of the vertical post 20, an insertion slot 54 is formed between the middle plate portion 51 of the hook member 50 and the inner lateral face 22 of the vertical post 20. It is noted the hook members 50 separately hooked to two facing inner lateral faces 22 on two adjacent vertical posts 20 are located at the same height on the vertical posts 20.

Each of the crossbars 30 is formed at two lateral ends on a lower portion thereof with a downward extended insertion section 31 each for inserting into the insertion slots 54 formed between two hook members 50 and each of the two facing inner lateral faces 22 of the two adjacent vertical posts 20, so that the two vertical posts 20 can be supported by the crossbars 30 to stably stand upright. Since each of the insertion sections 31 has a width smaller a distance between the middle plate portion 51 of the hook member 50 and the inner lateral face 22 of the vertical post 20, the insertion sections can be easily inserted into the insertion slots 54.

The crossbars 30 are hollow pipes having a substantially rectangular cross-sectional shape. The insertion sections 31 are formed by inward compressing a lower front and a lower rear face of the crossbar 30 at two lateral ends thereof, so that the insertion sections 31 each have an overall thickness smaller than that at other portions of the crossbar 30. An anti-slide element 33 is inserted into each of the two lateral ends of the crossbar 30. The anti-slide element 33 includes an end plate 331 and an insert body 332 connected to an inner face of the end plate 331. The insert bodies 332 have a configuration similar to that of the two lateral ends 31 of the crossbar 30 for fitly inserting thereinto. Each of the anti-slide elements 33 is further provided on the end plate 331 with an inverted U-shaped cover plate 333 for covering an upper half of the end plate 331 and the insert body 332. A space is formed between the inverted U-shaped cover plate 333 and the insert body 332 for receiving an upper half of the crossbar 30 that is not compressed to form the insertion section 31 when the insert body 332 is inserted into the lateral end of the crossbar 30. When the insertion section 31 has been inserted into the insertion slot 54, the anti-slide element 33 corresponding to the insertion section 31 is compressed by and between the inner lateral face 22 of the vertical post 20 and the middle plate portion 51 of the hook member 50 to thereby produce a tightening effect, enabling the crossbar 30 to tightly connected at the lateral end to the vertical post 20 via the hook member 50.

Two adjacent vertical posts 20 with at least an upper and a lower crossbar 30 connected to and between them can form a basic frame for the sectional rack of the present invention to stand upright. Additional crossbars 30 and hook members 50 can be further connected to the outer lateral faces 23 of the two adjacent vertical posts 20 for additional vertical posts 20 to connect thereto. Thus, the sectional rack of the present invention can be laterally extended without specific limitation to its overall width.

It is noted a groove 32 is formed between each of the insertion sections 31 and a main body of the crossbar 30 for receiving the middle plate portion 51 of the hook member 50 therein. The groove 32 has a widened lower opening 321, enabling the middle plate portion 51 of the hook member 50 to easily move into the groove 32 and accordingly, enabling convenient assembling of the sectional rack.

Figure 9:
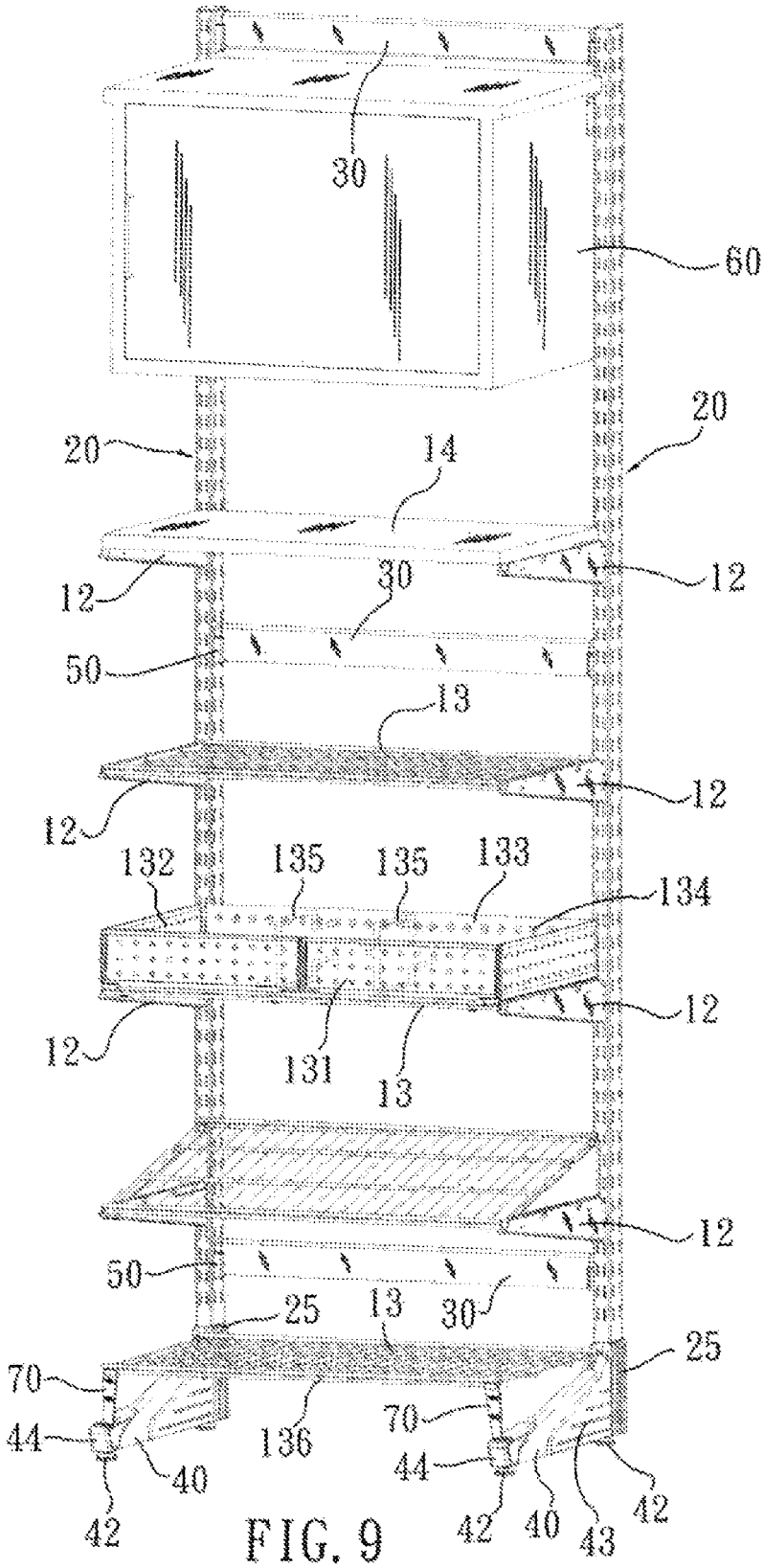
FIG. 9 is a perspective view showing an example of the sectional rack in use.

FIG. 9 is an assembled perspective view showing the sectional rack of the present invention in use. As shown, a plurality of support brackets 12 can be connected to the hanging holes 211 on the front faces of the vertical posts 20, so that metal-wire shelves 13 and rigid shelves 14 can be supported on the support brackets 12 for holding different things and articles thereon. Wall members 131, 132 can be further connected to a front side and two opposite lateral sides of the metal-wire shelf 13, respectively, and a backplate 133 with a plurality of small holes 134 can be further connected to and between the two adjacent vertical posts 20, so that these wall members 131, 132 and backplate 133 together enclose a receiving space on the metal-wire shelf 13. One or more partition members 135 can be connected to the small holes 134 on the backplate 133 to divide the receiving space on the metal-wire shelf 13 into several sub-spaces for orderly holding books, files, etc.

Figure 10:
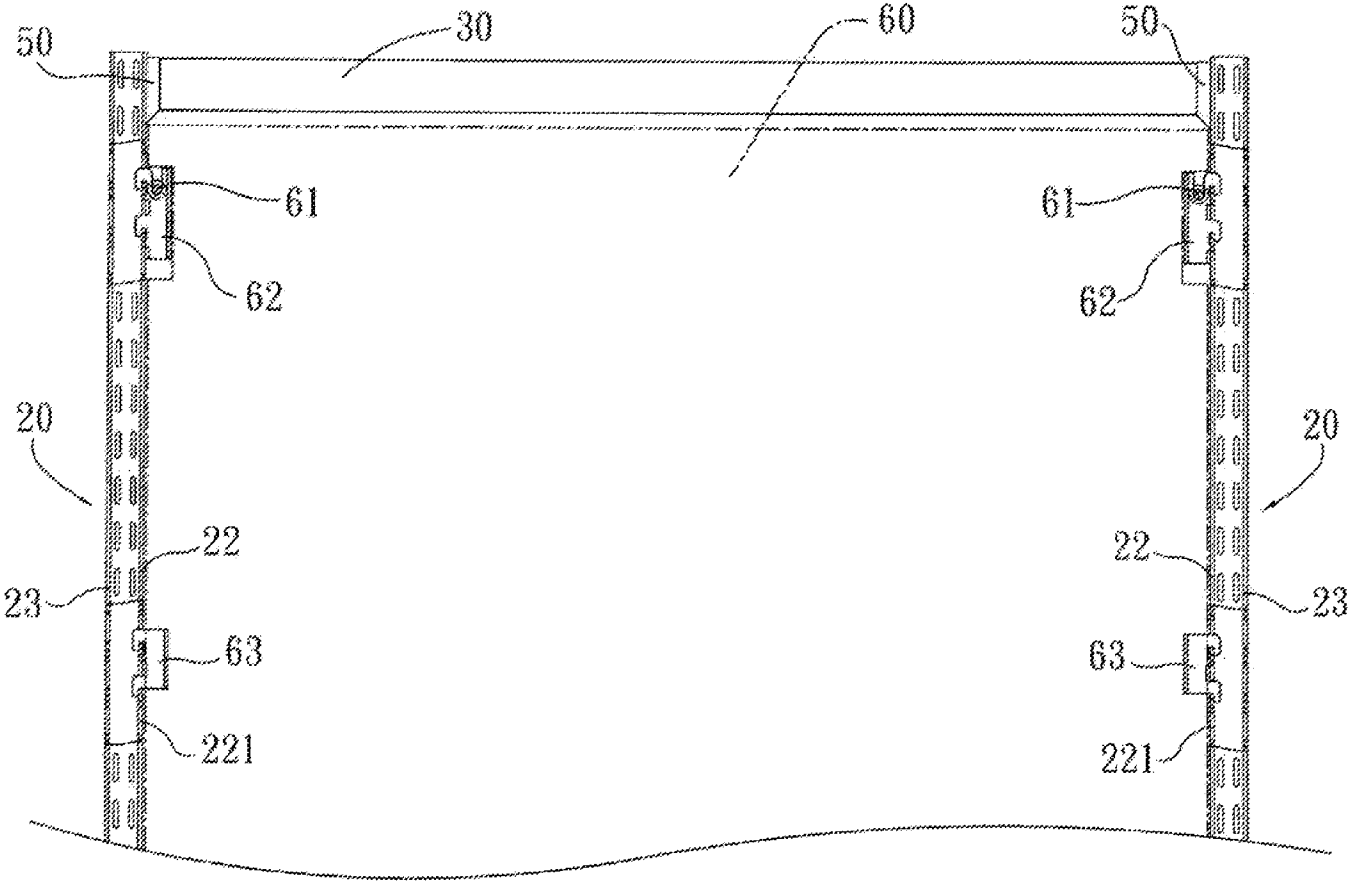
FIG. 10 is a rear view showing the manner of mounting a cabinet to the sectional rack of the present invention.

Please refer to FIGS. 9 and 10 at the same time. Hangers 62 can be hooked to the hanging holes 221 on two facing inner lateral faces 22 of two adjacent vertical posts 20, so that a cabinet or similar box-shaped container 60 can be hung to the sectional rack via engagement of hooks 61 provided on a back panel of the cabinet with the hangers 62. To prevent a lower part of the cabinet 60 from swinging relative to the vertical posts 20, two stoppers 63 can be further hooked to other hanging holes 221 at a lower position for abutting on a lower portion of the back panel of the cabinet 60.

As can be seen from FIGS. 4, 5, and 6, a substantially tubular first ornamental member 25 is fitted around the lower end of the vertical post 20, and the first ornamental member 25 is provided at a front and a rear side with an opening 251 each; and a second ornamental member 43 is fitted to a rear portion of the foot member 40, and the second ornamental member 43 has a rear end being extended into the front opening 251 of the first ornamental member 25. The first ornamental member 25 is provided at an upper end of the front opening 251 with a downward extended front pin 252, and the second ornamental member 43 is provided at a position corresponding to the pin 252 with a front recess 431. When the front pin 252 is inserted into the front recess 431, the first ornamental member 25 and the second ornamental member 43 are connected to each other. A back cover 26 is used to close the rear opening 251 of the first ornamental member 25. The rear opening 251 is also provided at an upper end with a downward extended rear pin 252, and the back cover 26 is correspondingly provided at an upper end with a rear recess 261 for engaging with the rear pin 252.

Figure 11:
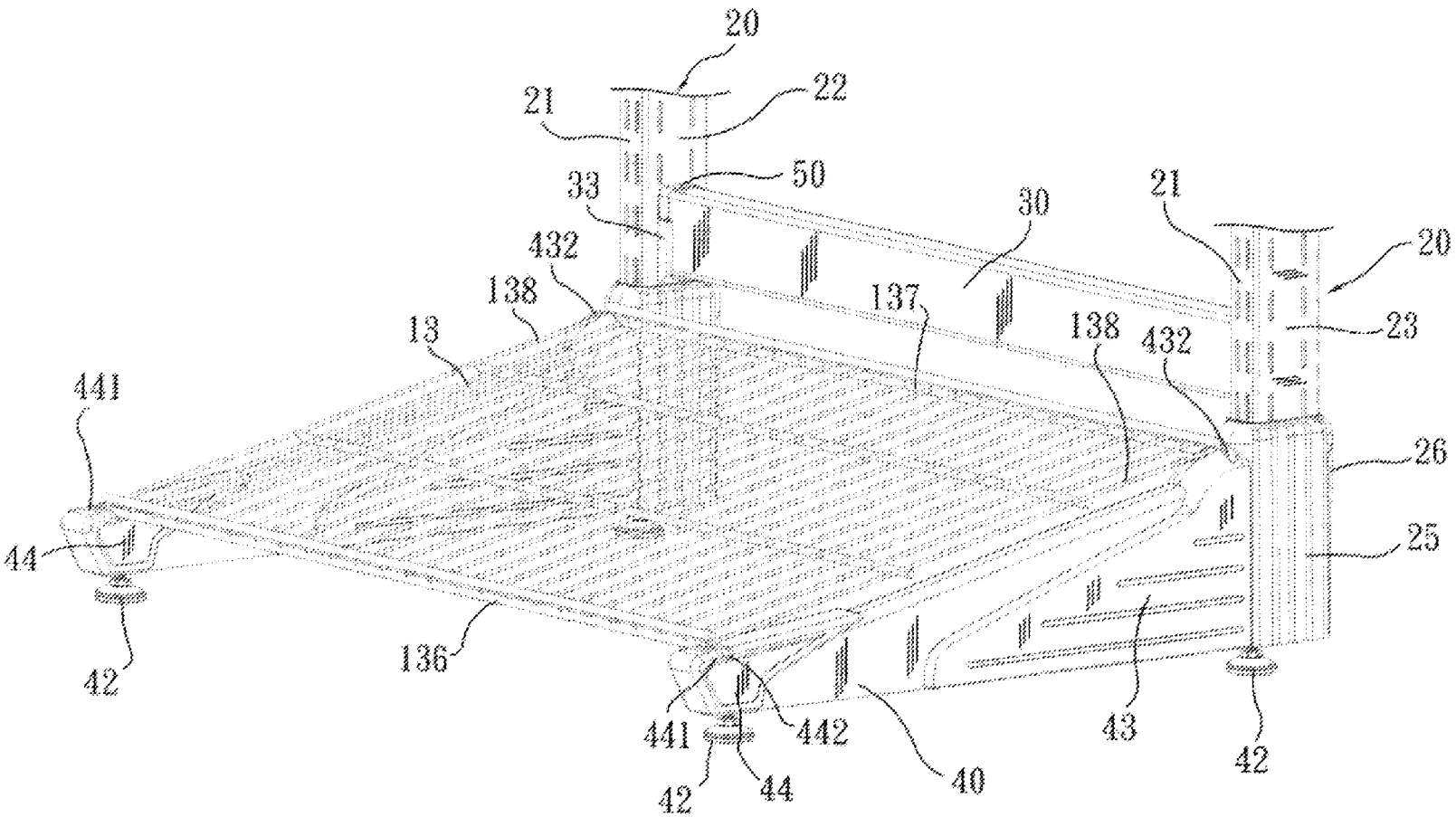
FIG. 11 shows a metal-wire shelf is mounted on two foot members of the sectional rack of the present invention to provide an inclined plane.

Please refer to FIGS. 5 and 11 at the same time. A third ornamental member 44 is fitted to a front portion of the foot member 40. The third ornamental member 44 is provided at a top with a front and a rear groove 441, 442 that are spaced from each other. The second ornamental member 43 is provided on a top with a substantially T-shaped groove 432, which includes a transverse section and a longitudinal section. A metal-wire shelf 13 can be connected to and between two foot members 40 by firmly setting a rear boundary metal wire 137 of the metal-wire shelf 13 in the transverse sections of the T-shaped grooves 432 on the two second ornamental members 43, and a front boundary metal wire 136 of the metal-wire shelf 13 in the rear grooves 442 on the two third ornamental members 44, so that the metal-wire shelf 13 is laid on the two foot members 40 to provide a forward inclined plane. At this point, rear ends of two lateral boundary metal wires 138 of the metal-wire shelf 13 are received in the longitudinal sections of the T-shaped grooves 432 on the two second ornamental members 43.

Figure 12:
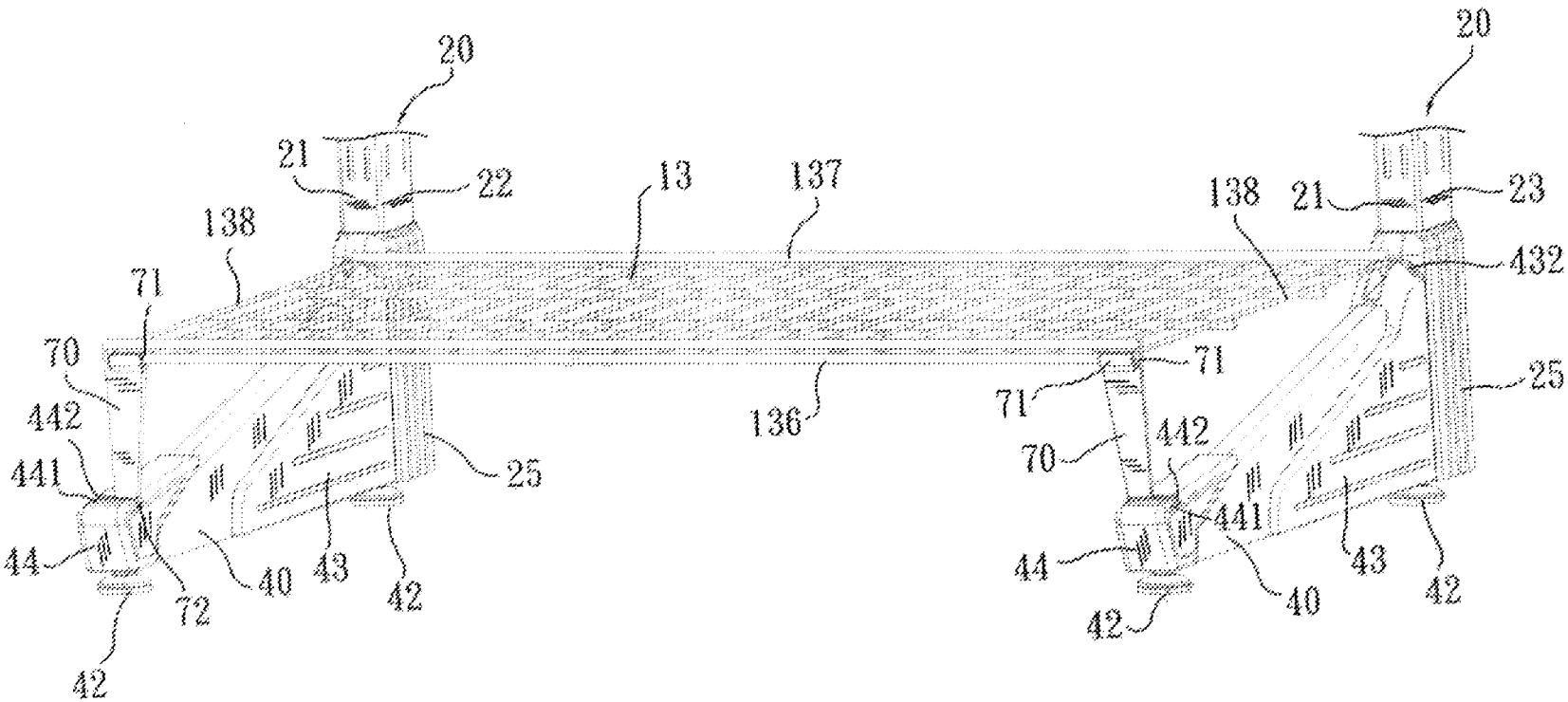
FIG. 12 shows a metal-wire shelf is mounted on two foot members of the sectional rack of the present invention to provide a horizontal plane.

The metal-wire shelf 13 can be otherwise mounted to and between two foot members 40 to provide a horizontal plane, as shown in FIG. 12. To do so, two supporting brackets 70 are further provided. Each of the supporting brackets 70 includes an upper end formed into an open-topped and transversely extended channel 71, and a lower end formed into a transversely extended protrusion 72. The lower transverse protrusions 72 of the two supporting brackets 70 can be engaged with the front grooves 441 on the two third ornamental members 44 on the foot members 40, so that the two supporting brackets 70 are held to an upright position. Thereafter, the front boundary metal wire 136 of the metal-wire shelf 13 is set in the transverse channels 71 on the tops of the two upright supporting brackets 70, so that the metal-wire shelf 13 is held in a horizontal plane.

Figure 13:
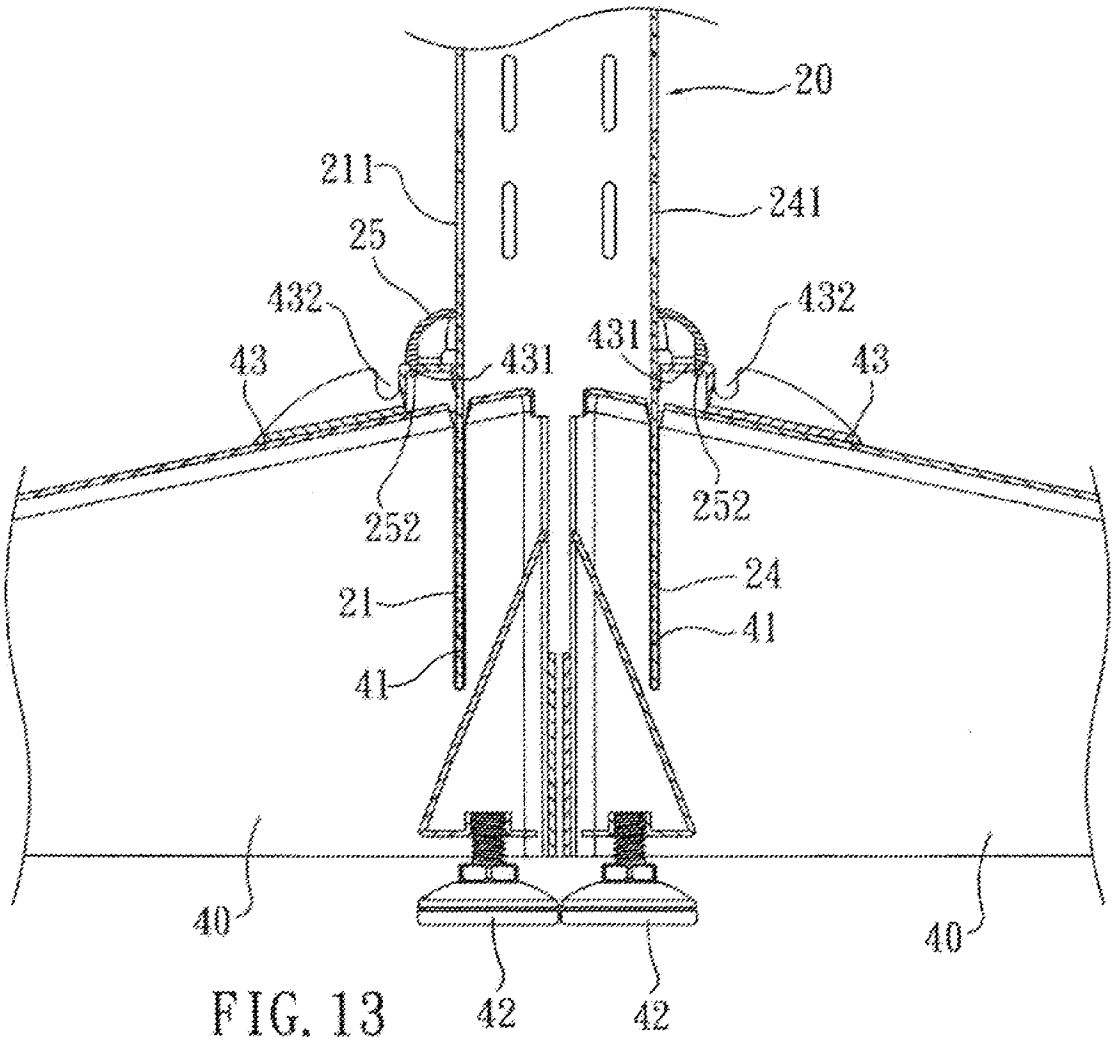
FIG. 13 is a fragmentary sectioned side view showing the vertical post of the sectional rack of the present invention with two foot members separately connected to front and rear sides thereof.

When it is desired to set the sectional rack of the present invention near a wall, the foot members 40 are connected only to the front faces 21 of the two vertical posts 20. However, as shown in FIG. 13, two additional foot members 40 can be further connected to the lower end of the two vertical posts 20 at the rear faces 24 thereof, so that the sectional rack can have increased supporting bottom areas. Therefore, the metal-wire shelves 13, the rigid shelves 14, or other types of organizing devices can be mounted to both front and rear sides of the sectional rack.

The sectional rack according to the present invention can be erected without the need of using other fastening elements and tools, and can therefore be very conveniently assembled and disassembled. Moreover, since the hanging holes provided on the front and the rear faces of the vertical posts enable the mounting of the metal-wire shelves and the rigid shelves to the sectional rack, and the hanging holes provided on the inner and outer lateral faces of the vertical posts enable the mounting of cabinets to the sectional rack, the sectional rack of the present invention is a multi-function rack.

What is claimed is:

1. A sectional rack, comprising at least two vertical posts, at least two foot members, at least two crossbars, and a plurality of hook members being twice as much as the crossbars in number;

each of the vertical posts being a hollow pipe having a substantially rectangular cross-sectional shape, and being provided on each of a front and a rear face with at least one vertical row of hanging holes, and on each of two lateral faces with two vertical rows of hanging holes;

each of the foot members being a long plate with a groove provided near a rear end thereof to vertically downward extend from a top of the foot member by a predetermined length to thereby cut through the top and two opposite side wall surfaces of the foot member; and the groove being sized for the front face at the lower end of the vertical post to insert thereinto, so that a portion of the foot member behind the groove is extended into the lower end of the hollow vertical post;

each of the hook members being a substantially lying U-shaped plate having a middle plate portion and two arm portions perpendicular to and parallelly extended from two opposite lateral edges of the middle plate portion; and the arm portions being formed at respective distal end with at least one hook portion for hooking to the two rows of hanging holes provided on the lateral faces of the vertical post, such that an insertion slot is formed between the middle plate portion of the hook member and the lateral face of the vertical post when the hook member has been hooked to the hanging holes on the lateral face of the vertical post; and each of the crossbars being provided at each of two lateral ends on a lower portion thereof with a downward extended insertion section, and the two insertion sections being respectively inserted into two insertion slots formed between two hook members and each of two facing lateral faces on two adjacent vertical posts, so that the two vertical posts are supported by the crossbars to stably stand upright.

2. The sectional rack as claimed in claim 1, wherein a groove is formed between each of the insertion sections and a main body of the crossbar for receiving the middle plate portion of the hook member therein.

3. The sectional rack as claimed in claim 2, wherein the crossbar is a hollow pipe having a substantially rectangular cross-sectional shape, and the insertion sections are formed by inward compressing a lower front and a lower rear face of the crossbar at two lateral ends thereof, so that the insertion sections each have an overall thickness smaller than that at other portions of the crossbar.

4. The sectional rack as claimed in claim 1, wherein the portion of the foot member extended into the lower end of the vertical post has two side wall surfaces pressing against an inner side of the two lateral faces of the vertical post, preventing the vertical post from swaying on the foot member.

5. The sectional rack as claimed in claim 1, further comprising an anti-slide element inserted in each of the two lateral ends of the crossbars; the anti-slide element including an end plate and an insert body connected to an inner face of the end plate, the insert body having a configuration corresponding to that of each of the lateral ends of the crossbars for fitly inserting thereinto; and the anti-slide element being compressed by and between the lateral face of the vertical post and the middle plate portion of the hook member.

6. The sectional rack as claimed in claim 5, wherein the anti-slide element is further provided on the end plate with an inverted U-shaped cover plate for covering an upper half of the end plate and the insert body; and a space being formed between the inverted U-shaped cover plate and the insert body, so that an upper half of the crossbar above the insertion section can be received in the space.

7. The sectional rack as claimed in claim 1, further comprising a first and a second ornamental member for each of the rectangular-sectioned vertical posts and each of the foot members, respectively; the first ornamental member being a substantially tubular member for fitting around the lower end of the vertical post and having a front and a rear opening; the second ornamental member being fitted to a rear portion of the foot member, and having a rear end extended into the front opening of the first ornamental member.

8. The sectional rack as claimed in claim 7, wherein the first and the second ornamental member are correspondingly provided at each contacted position between them with a downward extended pin and a recess, respectively, and the first and the second ornamental member being connected to each other through engagement of the pin with the recess.

9. The sectional rack as claimed in claim 7, wherein the second ornamental member is provided on a top with a substantially T-shaped groove.

10. The sectional rack as claimed in claim 7, further comprising a third ornamental member being fitted to a front portion of the foot member, and the third ornamental member being provided at a top with a front and a rear groove that are spaced from each other.

11. The sectional rack as claimed in claim 7, further comprising a back cover for closing the rear opening of the first ornamental member.

12. The sectional rack as claimed in claim 1, wherein there is also one foot member connected to the rear face of each of the vertical posts, such that the rear face at the lower end of the vertical post is inserted into the vertical groove on the foot member.

* * * * *